US007153255B2

(12) United States Patent
Gillengerten et al.

(10) Patent No.: US 7,153,255 B2
(45) Date of Patent: Dec. 26, 2006

(54) SCREW CENTRIFUGE FOR THE WET MECHANICAL SEPARATION OF SOLIDS

(75) Inventors: Frank Gillengerten, Cologne (DE); Günter Haider, Vilsbiburg (DE); Robert Wagenbauer, Wurmsham (DE)

(73) Assignee: Hiller GmbH, Vilsbiburg (DE)

( * ) Notice: Subject to any disclaimer, the term of this patent is extended or adjusted under 35 U.S.C. 154(b) by 0 days.

(21) Appl. No.: 10/508,439

(22) PCT Filed: Mar. 20, 2003

(86) PCT No.: PCT/EP03/02907

§ 371 (c)(1),
(2), (4) Date: Jan. 7, 2005

(87) PCT Pub. No.: WO03/078070

PCT Pub. Date: Sep. 25, 2003

(65) Prior Publication Data

US 2005/0107236 A1 May 19, 2005

(30) Foreign Application Priority Data

Mar. 20, 2002 (DE) ..... 102 12 187

(51) Int. Cl.
*B04B 1/20* (2006.01)
*B04B 11/08* (2006.01)

(52) U.S. Cl. ..... 494/53; 494/57

(58) Field of Classification Search ..... 494/50–57; 210/380.1, 380.3

See application file for complete search history.

(56) References Cited

U.S. PATENT DOCUMENTS 2,528,974 A * 11/1950 Ritsch ..... 494/35
2,919,848 A * 1/1960 Howe ..... 494/42
3,782,623 A * 1/1974 Bye-Jorgensen et al. ..... 494/51
4,037,781 A * 7/1977 High ..... 494/51
4,147,293 A * 4/1979 Hemfort ..... 494/22
5,234,400 A * 8/1993 Kluge ..... 494/54
5,252,209 A * 10/1993 Retter ..... 210/380.3
5,306,225 A * 4/1994 Miyano et al. ..... 494/53
5,342,281 A * 8/1994 Unkelbach et al. ..... 494/53
6,290,636 B1 * 9/2001 Hiller et al. ..... 494/53
6,572,524 B1 * 6/2003 Caldwell ..... 494/53
7,056,273 B1 * 6/2006 Ostkamp et al. ..... 494/56
2005/0107236 A1 * 5/2005 Gillengerten et al. ..... 494/53

FOREIGN PATENT DOCUMENTS

DE 2651657 A1 * 5/1978

(Continued)

*Primary Examiner*—Charles E. Cooley
(74) *Attorney, Agent, or Firm*—Cohen, Pontani, Lieberman & Pavane

(57) ABSTRACT

A screw centrifuge for the wet-mechanical separation of a mixture of solids in a carrier liquid to produce sinks and floats, including a rotor which rotates about a horizontal axis, the rotor having a cylindrical wall and two conical walls, and a conveyor screw which is mounted for rotation coaxially inside the rotor, the conveyor screw including a shaft and a pair of helical blades which are pitched in opposite directions. At least one feed opening is provided in the shaft for feeding a mixture of solids radially into a space between the shaft and the rotor, and discharge openings for respective sinks and floats are provided in the rotor at respective ends of respective conical drums. A baffle device extends radially inward from the rotor for producing a first liquid level for the sinks and a second liquid level for the floats.

12 Claims, 3 Drawing Sheets

FOREIGN PATENT DOCUMENTS

| | | | | |
|---|---|---|---|---|
| DE | 19516636 | A1 | * | 2/1996 |
| EP | 1020227 | A1 | * | 7/2000 |
| GB | 2064997 | A | * | 6/1981 |
| GB | 2083381 | A | * | 3/1982 |
| WO | 94/01219 | | * | 1/1994 |

* cited by examiner

SCREW CENTRIFUGE FOR THE WET MECHANICAL SEPARATION OF SOLIDS

PRIORITY CLAIM

This is a U.S. national stage of application No. PCT/EP03/02907, filed on 20 Mar. 2003. Priority under 35 U.S.C. § 119(a) and 35 U.S.C. §365(b) is claimed from German Application No. 102 12 187.7, filed 20 Mar. 2002.

BACKGROUND OF THE INVENTION

1. Field of the Invention

The invention pertains to a screw centrifuge for the wet-mechanical separation of mixtures of solids including a rotor formed by a cylindrical wall and two conical walls which rotate about a horizontal axis; a conveyor screw which is mounted for rotation coaxially inside the rotor, the conveyor screw having helical blades which are pitched in opposite directions; means for feeding a mixture of solids axially into the centrifuge; and discharge openings for respective sinks and floats at respective ends of respective conical walls.

2. Description of the Related Art

A wet centrifuge of this type is known from EP 1 020 227 A, for example. One of the two oppositely directed screws of the screw conveyor conveys the sinks, which have been spun outward to the drum jacket of the rotor, to the discharge openings formed at one end of the rotor, whereas the other screw conveys the lighter floats, which float on the carrier liquid, to the discharge openings at the other, conical end of the rotor. The level of the carrier liquid is constant over the entire length of the rotor.

SUMMARY OF THE INVENTION

The invention is based on the task of making it possible to adjust the moisture contents of the sinks and the floats independently of each other.

According to the invention, this task is accomplished by providing a radially inward-projecting baffle device is provided on the rotor to generate different liquid levels, one for the sinks and another for the floats.

With this solution, a sorting decanter is made available, which is made up in practice of two interconnected decanters, where the heavy sinks are discharged from the one decanter, and the lighter floats are discharged from the other decanter. The two decanters are separated from each other here by the inward-projecting baffle device.

The screw centrifuge according to the invention is suitable in particular for the separation of plastics of different densities such as PVC or PA and PP, which are suspended in the carrier liquid.

In an elaboration of the invention, the baffle device consists of a baffle ring, which leaves a ring-shaped gap free between it and the shaft of the conveyor screw and which is located upstream—with respect to the transport direction of the floats—of the minimum of one overflow pipe for the carrier liquid, the radially inward-directed inlet of this pipe being a certain distance away from the shaft of the conveyor screw.

It is especially advantageous for the overflow pipe to be radially adjustable so that the distance from the shaft can be varied. In this way, the level of the liquid in the area of the screw which discharges the floats can be varied, as a result of which the length of the drying section through which the floats must pass before they are discharged and thus the residual moisture content of the floats can be determined in advance.

In a further embodiment of the invention, the baffle ring has a U-shaped groove profile, which surrounds the overflow pipe; this profile consists of a radial ring, which is attached to the rotor wall; a transition piece, which forms the base of the groove profile; and an adjacent barrier wall, the free edge of which is a short distance away from the rotor wall.

As an elaboration of this feature, the baffle ring is provided with means for adjusting the size of the ring-shaped gap.

In this way, it is possible to specify in advance the level of the liquid for the sinks as well, which means that the length of the drying section through which the heavy phase separated from the carrier liquid must pass before it enters the discharge openings can be varied. A longer drying section also means here a longer residence time before discharge and thus a lower residual moisture content for the sinks.

DETAILED DESCRIPTION OF THE PRESENTLY PREFERRED EMBODIMENTS

Figure 1:
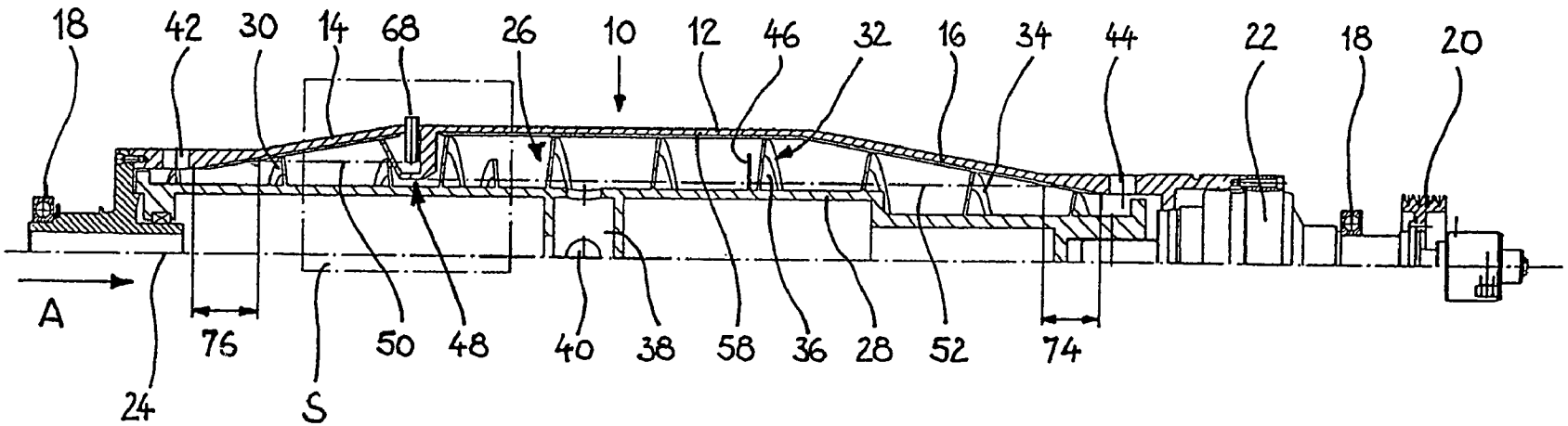
FIG. 1 shows a longitudinal cross section through the upper half of a screw centrifuge according to the invention.

As FIG. 1 shows, the screw centrifuge has a rotor 10, which is made up of a central cylindrical drum 12 and two conical drums 14, 16, which are connected permanently to the center drum. In a housing (not shown), two roller bearings 18 are provided to support the rotor 10. A belt pulley 20, which is used to drive the rotor 10 in rotation around its horizontal axis 24, and a gearbox 22 are indicated on the right in FIG. 1.

In the rotor 10, a conveyor screw 26 is supported, which is driven around the same axis 24 as that of the rotor 10 by the gearbox 22 but at a speed different from that of the rotor. The conveyor screw 26 consists of a hollow shaft 28, on which two oppositely directed screws 30, 32 are mounted. The helices 34 of the two screws 30, 32 have openings 36 in the area near the shaft 28.

The mixture to be separated, which is suspended in a carrier liquid, is supplied in the direction of the arrow A in FIG. 1 by means of a stationary or rotating feed pipe (not shown). The mixture thus passes through the hollow shaft 28 and enters a chamber 38, which is formed in the central area of the shaft 28. From there, the mixture passes through the radial openings 40 and enters the space between the conveyor screw 26 and rotor 10.

Discharge openings 42 for the light phase (the floats), which are machined into the drum wall, are provided in a ring around the end of the conical drum 14 on the left in FIG. 1. Corresponding discharge openings 44 for the heavy phase (the sinks) are machined into the end of the opposite conical drum 16.

In the area of the cylindrical drum 12, a baffle disk 46 is attached to the shaft 28 of the conveyor screw 26; this disk prevents the floats from remixing with the suspension.

According to the invention, a radially inward-projecting baffle device 48 is attached to the rotor 10; in the exemplary embodiments, this device is located at the transition between the cylindrical drum 12 and the conical drum 14 on the left in FIG. 1. In the manner to be described below, the baffle device 48 has the effect that the liquid level 50 produced for the floats, which are discharged via the discharge openings 42, is different from the liquid level 52 for the sinks, which are separated via the discharge openings 44 at the right end of the rotor 10. Note in each case that the liquid lies radially outward of the liquid level.

The baffle device 48 consists of a baffle ring 54 which, in longitudinal cross section, has a U-shaped groove profile. This groove profile consists of a ring 56, which is attached to the rotor wall 58 and projects inward from this wall; an axial transition piece 60, which forms the base of the groove profile; and an adjacent barrier wall 62, which slants away from the transition piece 60. Between the transition piece 60 and the shaft 28 of the screw 30, a ring-shaped gap 64 is present. The free end of the barrier wall 62 is a short radial distance 66 away from the rotor wall 58.

Figure 3:
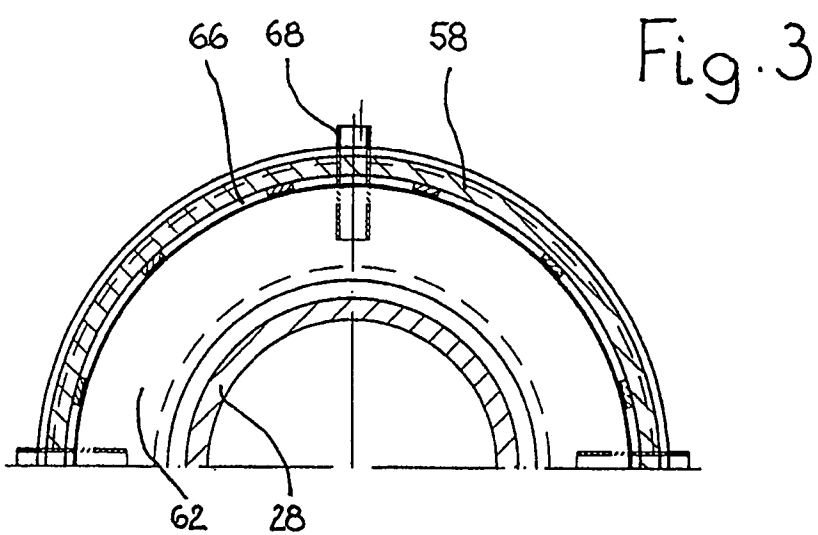
FIG. 3 shows a vertical cross section along plane III—III of FIG. 2.
Figure 2:
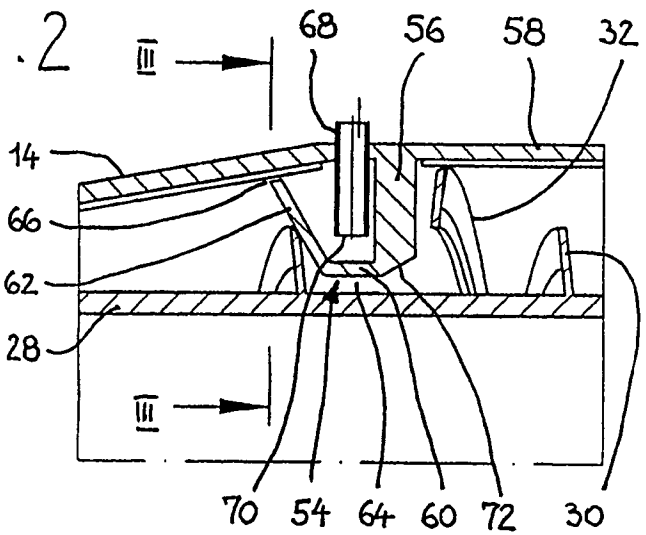
FIG. 2 shows an enlarged drawing of area "S" of FIG. 1 with the baffle device.

FIGS. 2 and 3 show that, in the area of the baffle ring 54, four overflow pipes 68 are mounted in the rotor wall 58; the radially inward-facing inlets 70 of these pipes open out into the U-shaped groove profile of the baffle ring 54. The overflow pipes 68 are adjustable in the radial direction by means of suitable devices (not shown), as indicated in FIGS. 2, 4, 6, and 8 by double arrows.

In the exemplary embodiment according to FIGS. 1–3, the baffle ring 54 is permanently connected to the rotor wall 58 and has a bevel 72 in the area between the ring 56 and the transition piece 60.

As previously mentioned, the suspension to be separated, such as plastic pieces of different weights suspended in a carrier liquid, arrives via the openings 40 in the hollow shaft 28 in the area of the cylindrical drum 12, where the liquid level 52 is determined by the ring-shaped gap 64, that is, by the distance between the transition piece 60 and the shaft 28 of the conveyor screw 26. The solid particles with the higher specific gravity are spun against the wall 58 of the rotor as a result of the centrifugal force generated by the rotor 10, whereas the solid particles with lower specific gravity float on the surface of the liquid level 52. The screw 32 transports the heavy phase (the sinks) toward the right in FIG. 1 to the discharge openings 44. At the end of the conical drum 16, a drying section 74 of greater or lesser length is formed as a function of the level 52 of the liquid; at the beginning of this section, the solid particles are lifted by the screw 32 out of the carrier liquid and transported along this drying section 74 to the discharge openings 44.

The baffle ring 54 can be replaced with a larger or a smaller baffle ring to change the size of the ring-shaped gap 64, i.e., to provide it with either a smaller or a larger radial dimension. As a result, the liquid level 52 and therefore the length of the drying section 74 can be changed.

The floats, i.e., the material of lower specific gravity floating on the top 52 of the liquid, are conveyed via the radially smaller screw 30 in the opposite direction toward the ring-shaped gap 64, where the bevel 72 of the baffle ring 54 supports the overflow of the floats into the conical drum 14 on the left. In this drum, the liquid level 50 depends on the distance between the inlet 70 of the overflow pipe 68 and the shaft 28 of the conveyor screw 26. If, proceeding from the example of FIG. 2, the overflow pipe 68 is shifted radially outward, some of the carrier liquid will escape through the overflow pipe 68 until the new liquid level 50 is reached. As a result, regardless of the liquid level 52 for the sinks, the drying section 76 in the conical drum 14 on the left in FIG. 1 is increased. Conversely, this drying section 76 will be shortened when the overflow pipe 68 is shifted radially inward.

The distance 66 between the barrier wall 62 and the rotor wall 58 prevents the floats suspended in the carrier liquid from escaping outward through the overflow pipe 68.

Figure 5:
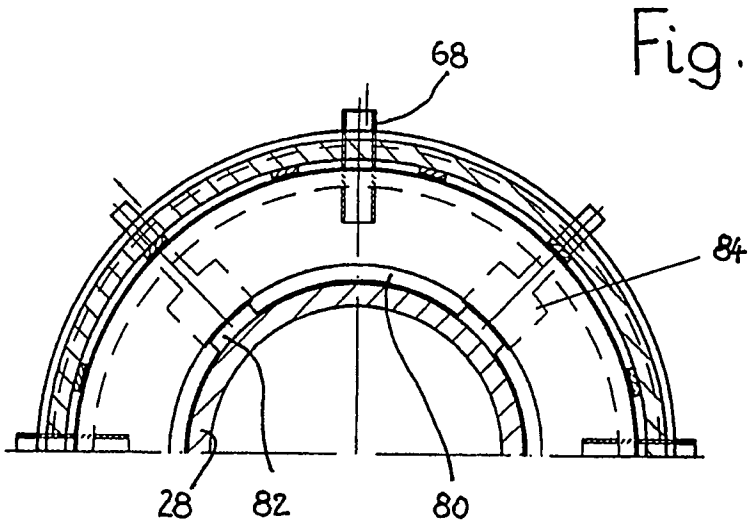
FIG. 5 shows a cross section along plane V—V of FIG. 4.
Figure 4:
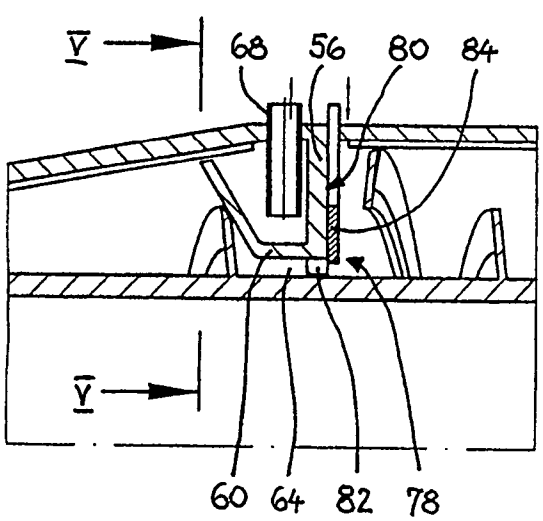
FIG. 4 shows a variant of FIG. 2.

In the exemplary embodiment according to FIGS. 4 and 5, the ring-shaped gap 64 is closed off by a diaphragm 78, which has a diaphragm ring 80 formed as an integral part of the ring 56; this diaphragm ring extends radially from the ring 56 as far as the lateral surface of the shaft 28 of the conveyor screw 26. Overflow windows 82 are machined into the inner edge of the diaphragm ring 80, these windows being distributed uniformly around the circumference of the ring. The openings of the windows can be made larger or smaller by weir plates 84. The weir plates 84 can be adjusted radially from the outside by the use of suitable elements (not shown), so that the radially inner edge of the weir plates 84 can determine the liquid level 52 in the cylindrical drum 12 and in the conical drum 16 on the right.

Figure 7:
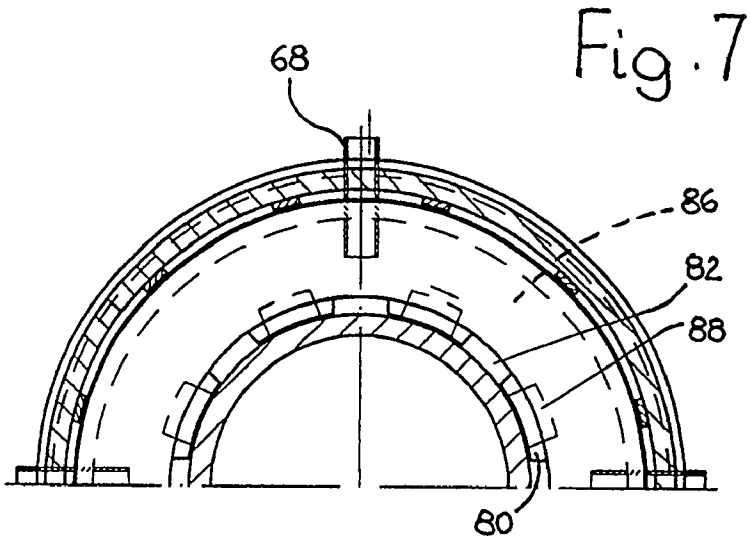
FIG. 7 shows a cross section along plane VII—VII of FIG. 6.
Figure 6:
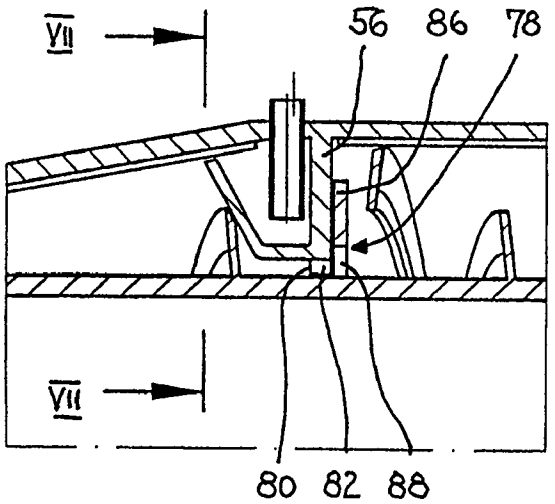
FIG. 6 shows a variant of FIG. 4.

In the variant according to FIGS. 6 and 7, the diaphragm 78 consists of two ring-shaped disks, which can be rotated with respect to each other, namely, the diaphragm ring 80, which is permanently connected to the ring 56 in this case as well, and a ring-shaped disk 86, situated upstream with respect to the overflow direction. This disk is connected to the conveyor screw 30 in a manner not shown and thus rotates along with the screw. Here, too, the diaphragm ring 80 has overflow windows 82; similar overflow windows 88 are machined into the ring-shaped disk 86 which rotates along with the screw 30, as a result of which, during the rotation of the screw 30, the floating material flows in a pulsating manner through the ring-shaped gap 64 and into the conical drum 14.

Figure 9:
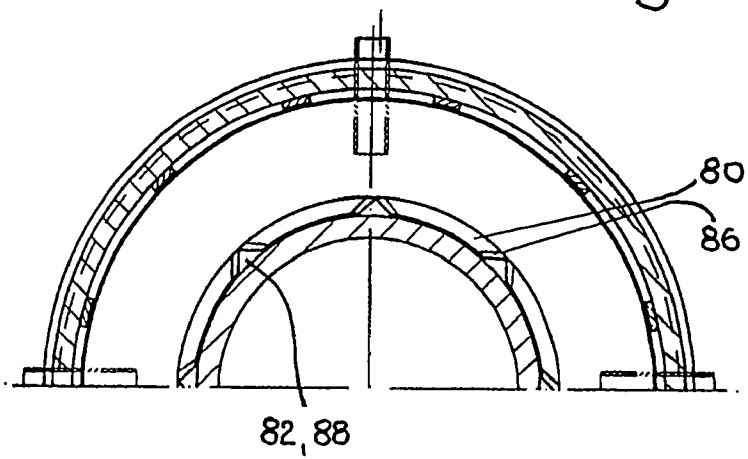
FIG. 9 shows a cross section along plane IX—IX of FIG. 8.
Figure 8:
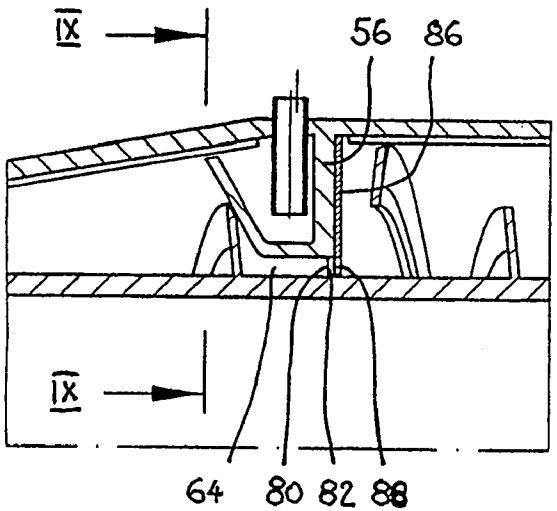
FIG. 8 shows a variant of FIG. 6.

In the exemplary embodiment according to FIGS. 8 and 9, the diaphragm 78 also consists of two ring-shaped disks which can rotate with respect to each other, namely, the diaphragm ring 80 and, axially upstream with respect to the transport direction, the ring-shaped disk 86, which is attached to the ring 56. The two disks have overflow windows 82, 88, which are on their radially inner edge and in the form of triangles. As a function of the degree to which they overlap, these windows determine the overall size of the opening through which the floats can flow into the conical drum 14. The ring-shaped disk 86 can be shifted with respect to the diaphragm ring 80, a step which is carried out when the centrifuge is assembled. Alternatively, it is also possible to use actuating elements (not shown) to rotate the ring-shaped disk 86 from the outside in the circumferential direction in order to adjust the size of the overflow windows 82, 88 in accordance with the requirements at hand.

What is claimed is:

1. A screw centrifuge for the wet-mechanical separation of a mixture of solids in a carrier liquid to produce sinks and floats, said centrifuge comprising:

a rotor which rotates about a horizontal axis, said rotor having a cylindrical wall and two conical walls;

a conveyor screw which is mounted for rotation coaxially inside said rotor, the conveyor screw comprising a shaft and a pair of helical blades which are pitched in opposite directions;

means for feeding a mixture of solids radially into a space between the shaft and the rotor via at least one feed opening in the shaft;

discharge openings in the rotor for respective sinks and floats at respective ends of respective conical walls; and a baffle device extending radially inward from said rotor and comprising an overflow pipe mounted in said rotor and having a radially inward facing inlet spaced a distance from said shaft and defining a liquid level for said floats; and a baffle ring mounted in said rotor upstream of the overflow pipe and forming a ring-shaped gap having a radial width between the baffle ring and the shaft, said width defining a liquid level for said sinks, wherein said conical walls converge toward respective mutually opposed ends which form drying sections for respective said sinks and floats, said drying section for said sinks having a length which is determined by the liquid level of said sinks, said drying section for said floats having a length which is determined by the liquid level of said floats.

2. The screw centrifuge of claim 1 wherein the distance between the overflow pipe and the shaft is greater than the radial width of the ring-shaped gap.

3. The screw centrifuge of claim 1 wherein the distance between the overflow pipe and the shaft can be adjusted.

4. The screw centrifuge of claim 1 wherein the baffle ring has a U-shaped channel profile enclosing the overflow pipe, the channel profile comprising a ring-shaped wall attached to the rotor, a transition piece facing said shaft, and a barrier wall extending radially outward from the transition piece, the barrier wall having a radial outward end which is spaced a distance from the rotor.

5. The screw centrifuge of claim 4 wherein the baffle ring further comprises a bevel between the ring-shaped wall and the transition piece.

6. The screw centrifuge of claim 1 further comprising means for adjusting the ring-shaped gap.

7. The screw centrifuge of claim 6 wherein the baffle ring is removably mounted in the rotor, whereby said ring-shaped gap can be adjusted by replacing the baffle ring.

8. The screw centrifuge of claim 6 further comprising an adjustable diaphragm closing off said ring-shaped gap.

9. The screw centrifuge of claim 8 wherein said adjustable diaphragm comprises a first ring-shaped disk and a second ring-shaped disk which are rotatable relative to each other, each said disk having a radially inner edge provided with overflow windows.

10. The screw centrifuge of claim 9 wherein said ring-shaped disks are attached to said baffle ring.

11. The screw centrifuge of claim 9 wherein said first ring-shaped disk is formed integral with said baffle ring and said second ring shaped disk is fixed to said conveyor screw for rotation with said conveyor screw.

12. The screw centrifuge of claim 8 wherein said diaphragm comprises a diaphragm ring which is fixed with respect to said baffle ring, said diaphragm ring having a radially inner edge provided with overflow windows, said centrifuge further comprising weir plates mounted for radial movement for variably closing said windows.

* * * * *